US011457699B2

(12) United States Patent
Lee

(10) Patent No.: US 11,457,699 B2
(45) Date of Patent: Oct. 4, 2022

(54) LUGGAGE LOCK AND ANTI-THEFT ZIPPER THEREOF

(71) Applicant: Shu Ming Lee, Taipei (TW)

(72) Inventor: Shu Ming Lee, Taipei (TW)

( * ) Notice: Subject to any disclaimer, the term of this patent is extended or adjusted under 35 U.S.C. 154(b) by 445 days.

(21) Appl. No.: 16/712,979

(22) Filed: Dec. 12, 2019

(65) Prior Publication Data

US 2021/0177106 A1 Jun. 17, 2021

(51) Int. Cl.
*A44B 19/30* (2006.01)
*E05B 65/52* (2006.01)

(52) U.S. Cl.
CPC ..... *A44B 19/305* (2013.01); *E05B 65/52* (2013.01)

(58) Field of Classification Search
CPC ..... A44B 19/305; E05B 65/52
See application file for complete search history.

(56) References Cited

U.S. PATENT DOCUMENTS 4,790,156 A * 12/1988 Yang ..... A44B 19/301 24/387
5,136,864 A * 8/1992 Spiekermann ..... A44B 19/301 70/68
6,467,135 B1 * 10/2002 Schuster ..... A44B 19/262 24/387
2014/0069757 A1 * 3/2014 Schlipper ..... A44B 19/301 24/386
2015/0040622 A1 * 2/2015 Meersschaert ..... A45C 13/10 70/69
2018/0332940 A1 * 11/2018 Ponti ..... A44B 19/305

* cited by examiner

*Primary Examiner* — Nader Bolourchi
(74) *Attorney, Agent, or Firm* — Hershkovitz & Associates, PLLC; Abe Hershkovitz

(57) ABSTRACT

An anti-theft zipper includes a first zipper slider, a first zipper puller, a second zipper slider, and a second zipper puller. The first zipper puller has a first connecting end, a first locking end, a first locking ring, and a first engaging portion. The first connecting end is connected to the first zipper slider. The first locking ring is disposed on the first locking end. The first engaging portion is formed on the first zipper puller. The second zipper puller has components and configuration corresponding to those of the first zipper puller. The first engaging portion engages with a second engaging portion of the second zipper puller, preventing the first zipper puller and the second zipper puller from rotating and moving relative to each other. A luggage lock includes the anti-theft zipper and a locking assembly locking the first locking ring and a second locking ring of the anti-theft zipper.

10 Claims, 5 Drawing Sheets

LUGGAGE LOCK AND ANTI-THEFT ZIPPER THEREOF

BACKGROUND OF THE INVENTION

1. Field of the Invention

The present invention relates to a lock, and more particularly to a luggage lock and an anti-theft zipper thereof.

2. Description of Related Art

While traveling abroad, daily necessities and personal belongings are packed in luggage for travelers to move in a convenient way. When the luggage is checked in, luggage theft may happen since the luggage is not by the travelers' side. The conventional luggage includes a zipper having two zipper sliders and two zipper pullers, and each one of the two zipper pullers is connected to a respective one of the two zipper sliders. The zipper can be unzipped or zipped by pulling both the two zipper pullers individually or by pulling one single zipper puller to make the corresponding zipper slider slide on a zipper chain. When zipping the zipper, pull both the two zipper pullers individually or pull one single zipper puller to make the corresponding zipper slider slide on the zipper chain until one of the two zipper sliders meets the other one. To prevent the zipper from accidentally opening and to protect the daily necessities and the personal belongings from potential thieves, the travelers often adapt an additional luggage lock to lock the two zipper pullers of the zipper. The two zipper pullers cannot be separated unless the additional luggage lock is unlocked to ensure that the conventional luggage cannot be opened.

Moreover, some conventional luggage has luggage locks fixed thereon. By pulling the two zipper pullers individually or pulling one single zipper puller to make the corresponding zipper slider slide on the zipper chain until one of the two zipper sliders meets the other one at a position near the conventional luggage lock and locking the two zipper pullers on the conventional luggage lock individually, the two zipper pullers cannot be separated. Therefore, the luggage locks fixed on the conventional luggage also provide an anti-theft effect to the conventional luggage. However, there are allowances between the two zipper pullers and the additional luggage lock and between the two zipper pullers and the luggage locks fixed on the conventional luggage, and thus the two zipper sliders can still be moved slightly after being locked. Even though the two zipper pullers are locked on the additional luggage lock or the luggage lock, the two zipper sliders can still be moved and separated to form a gap that enables a finger or a tool to reach inside of the conventional luggage. The potential thieves may destroy the conventional luggage via the gap between the two zipper sliders. In other cases, some travelers may lock one single zipper puller on the additional luggage lock or the conventional luggage lock but forget to lock the other one of the two zipper pullers on the additional luggage lock or the conventional luggage lock. Then the potential thieves can unzip the zipper by pulling the unlocked zipper puller.

To overcome the shortcomings of the conventional luggage lock, the present invention tends to provide a luggage lock and an anti-theft zipper thereof to mitigate or obviate the aforementioned problems.

SUMMARY OF THE INVENTION

The main objective of the present invention is to provide a luggage lock and an anti-theft zipper thereof.

The anti-theft zipper includes a first zipper slider, a first zipper puller, a second zipper slider, and a second zipper puller. The first zipper puller is connected to the first zipper slider and has two ends, a first connecting end, a first locking end, a first locking ring, and a first engaging portion. The first connecting end is disposed at one of the two ends of the first zipper puller, and is connected to the first zipper slider. The first locking end is disposed at the other one of the two ends of the first zipper puller. The first locking ring is disposed on the first locking end. The first engaging portion is formed on the first zipper puller, and is located between the first connecting end and the first locking end.

The second zipper puller is connected to the second zipper slider and has two ends, a second connecting end, a second locking end, a second locking ring, and a second engaging portion. The second connecting end is disposed at one of the two ends of the second zipper puller, and is connected to the second zipper slider. The second locking end is disposed at the other one of the two ends of the second zipper puller. The second locking ring is disposed on the second locking end. The second engaging portion is formed on the second zipper puller, and is located between the second connecting end and the second locking end. The first engaging portion engages with the second engaging portion, which prevents the first zipper puller and the second zipper puller from rotating and moving relative to each other.

The luggage lock is fixed on luggage, and includes the anti-theft zipper and a locking assembly. The anti-theft zipper is mounted on the luggage. The locking assembly is fixed on the luggage, and locks the first locking ring and the second locking ring of the anti-theft zipper.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
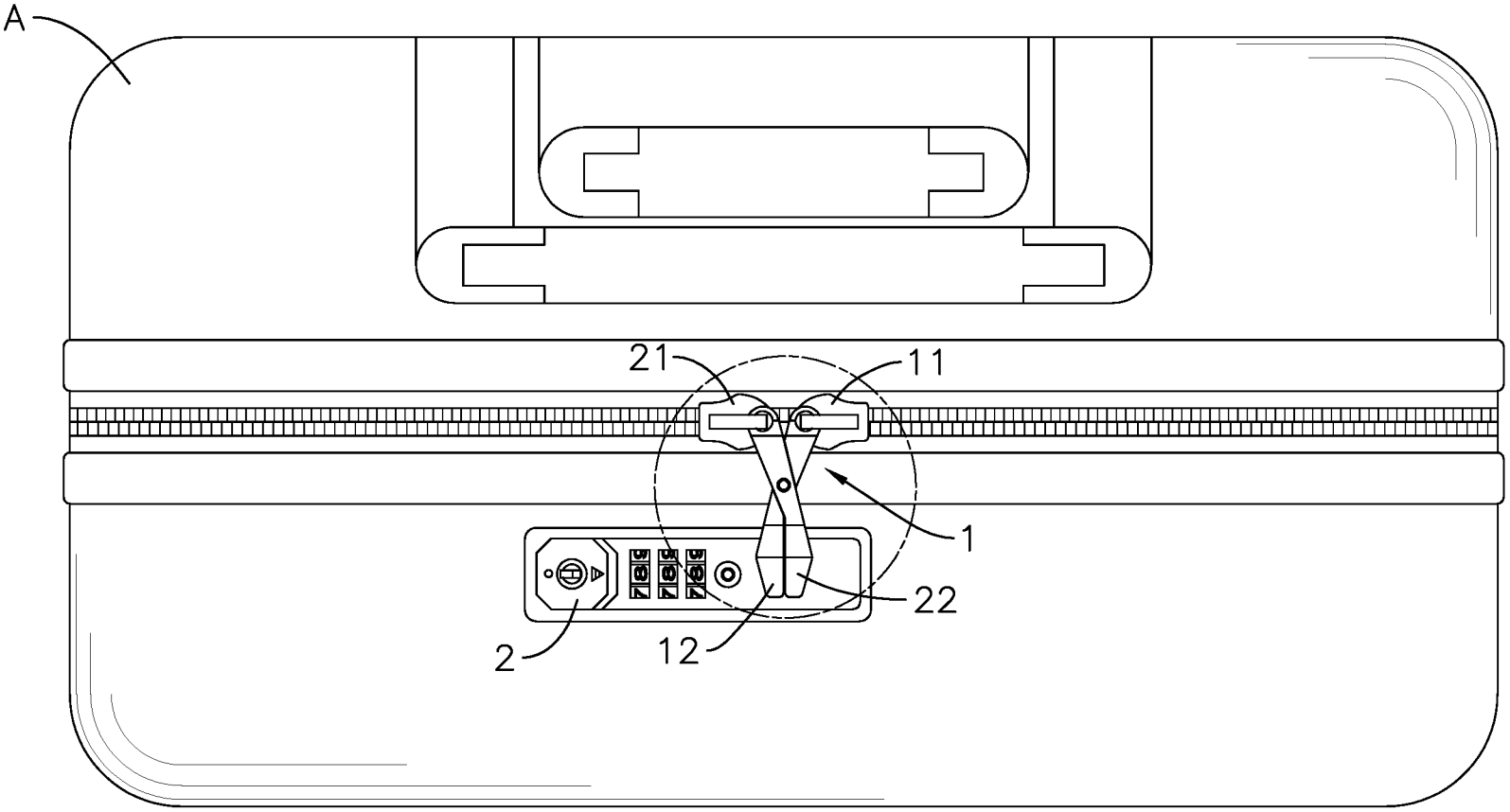
FIG. 1 is a top side view of a luggage lock in accordance with the present invention, mounted on luggage.
Figure 2:
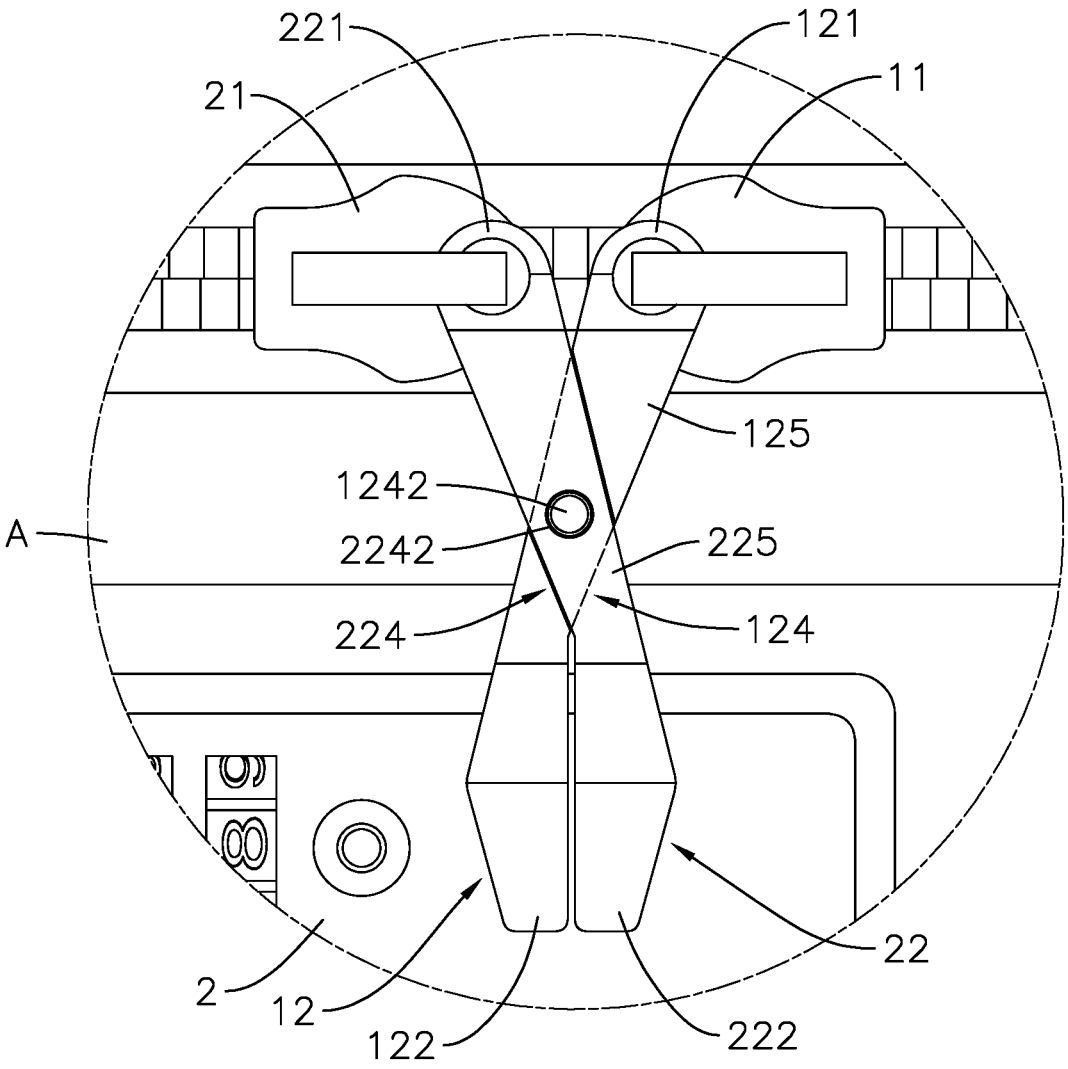
FIG. 2 is an enlarged top side view of an anti-theft zipper of the luggage lock in FIG. 1.

With reference to FIGS. 1 and 2, a luggage lock in accordance with the present invention is fixed on luggage A, and the luggage lock includes an anti-theft zipper 1 and a locking assembly 2.

Figure 3:
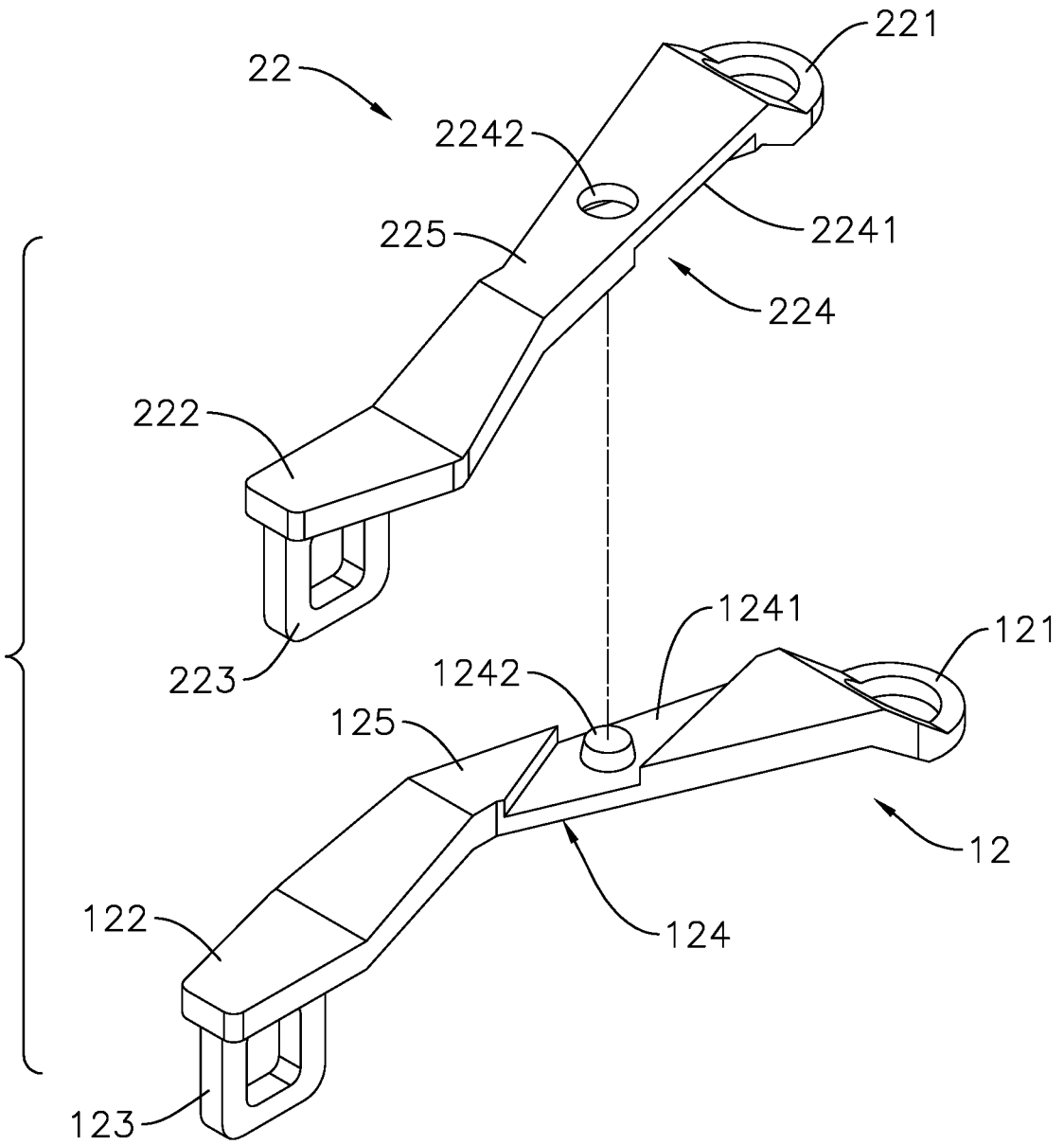
FIG. 3 is an exploded and enlarged perspective view of a first zipper slider and a second zipper slider of the anti-theft zipper of the luggage lock in FIG. 1.

With reference to FIGS. 1 to 3, the anti-theft zipper 1 is mounted on the luggage A, and has a first zipper slider 11, a first zipper puller 12, a second zipper slider 21, and a second zipper puller 22.

With reference to FIGS. 2 and 3, the first zipper puller 12 is connected to the first zipper slider 11 and has a first connecting end 121, a first locking end 122, a first locking ring 123, and a first engaging portion 124. The first connecting end 121 and the first locking end 122 are disposed at two ends of the first zipper puller 12, respectively. The first connecting end 121 is connected to the first zipper slider 11. The first locking ring 123 is formed on and protrudes from a bottom surface of the first locking end 122. The first engaging portion 124 is formed on the first zipper puller 12, and is located between the first connecting end 121 and the first locking end 122.

Similarly, the second zipper puller 22 is connected to the second zipper slider 21 and has a second connecting end 221, a second locking end 222, a second locking ring 223, and a second engaging portion 224. The second connecting end 221 and the second locking end 222 are disposed at two ends of the second zipper puller 22, respectively. The second connecting end 221 is connected to the second zipper slider 21. The second locking ring 223 is formed on and protrudes from a bottom surface of the second locking end 222. The second engaging portion 224 is formed on the second zipper puller 22, and is located between the second connecting end 221 and the second locking end 222. The first engaging portion 124 of the first zipper puller 12 engages with the second engaging portion 224 of the second zipper puller 22, preventing the first zipper puller 12 and the second zipper puller 22 from rotating or moving relative to each other.

Figure 4:
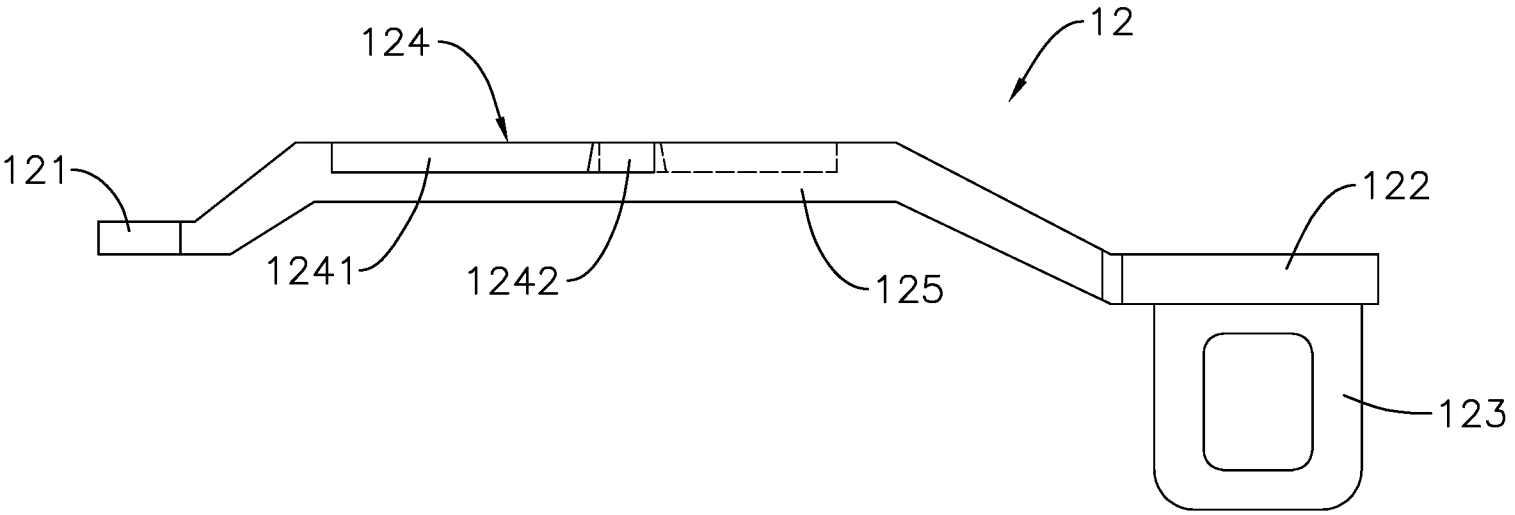
FIG. 4 is an enlarged side view of the first zipper puller of the anti-theft zipper of the luggage lock in FIG. 3.
Figure 5:
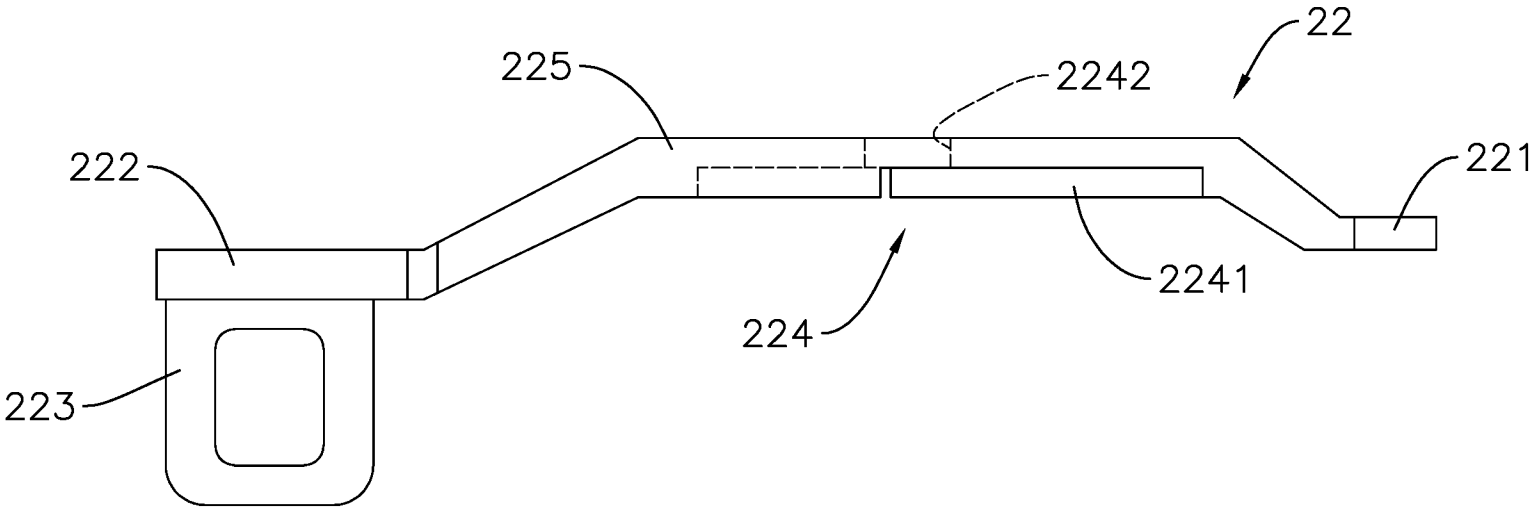
FIG. 5 is an enlarged side view of the second zipper puller of the anti-theft zipper of the luggage lock in FIG. 3.

With reference to FIGS. 3 to 5, the first engaging portion 124 further has a first limiting groove 1241 and a positioning protrusion 1242. Also, the first engaging portion 124 may have either the limiting groove 1241 or the positioning protrusion 1242. Similarly, the second engaging portion 224 further has a second limiting groove 2241 and a positioning groove 2242. The second engaging portion 224 may have either the second limiting groove 2241 corresponding to the first limiting groove 1241 or the positioning groove 2242 corresponding to the positioning protrusion 1242. In addition, the second engaging portion 224 may not have the second limiting groove 2241, and the first limiting groove 1241 of the first engaging portion 124 engages with the second engaging portion 224 of the second zipper puller 22. Likewise, the first engaging portion 124 may not have the first limiting groove 1241, and the second limiting groove 2241 of the second engaging portion 224 engages with the first engaging portion 124 of the first zipper puller 12.

With reference to FIGS. 2 and 3, in the present invention, the first zipper puller 12 further has a first left side and a first right side, and the first limiting groove 1241 is formed on the first engaging portion 124 and extends from the first left side to the first right side of the first zipper puller 12. Therefore, the first limiting groove 1241 forms a first left opening on the first left side of the first zipper puller 12, and forms a first right opening on the first right side of the first zipper puller 12. A width of the first left opening may be unequal to a width of the first right opening, such that a degree of freedom of the first zipper puller 12 and the second zipper puller 22 is decreased after the first engaging portion 124 of the first zipper puller 12 engages with the second engaging portion 224 of the second zipper puller 22. Therefore, the first engaging portion 124 of the first zipper puller 12 engages with the second engaging portion 224 of the second zipper puller 22 in a more stable manner.

With reference to FIGS. 2 and 3, likewise, the second zipper puller 22 further has a second left side and a second right side, and the second limiting groove 2241 is formed on the second engaging portion 224 and extends from the second left side to the second right side of the second zipper puller 22. Therefore, the second limiting groove 1241 forms a second left opening on the second left side of the second zipper puller 22, and forms a second right opening on the second right side of the second zipper puller 22. A width of the second left opening may be unequal to a width of the second right opening. Thus, the first engaging portion 124 of the first zipper puller 12 engages with the second engaging portion 224 of the second zipper puller 22 in a more stable manner, which prevents the first zipper puller 12 and the second zipper puller 22 detaching from each other.

With reference to FIGS. 2 and 3, the first zipper puller 12 is well clamped in the second limiting groove 2241 of the second engaging portion 224. In other words, the first left side and the first right side of the first zipper puller 12 abut against two inner surfaces of the second limiting groove 2241 respectively, such that the first zipper puller 12 cannot rotate relative to the second zipper puller 22 due to engagement of the first limiting groove 1241 and the second limiting groove 2241. Likewise, the second zipper puller 22 is well clamped in the first limiting groove 1241 of the first engaging portion 124. In other words, the second left side and the second right side of the second zipper puller 22 abut against two inner surfaces of the first limiting groove 1241 respectively, such that the second zipper puller 22 cannot rotate relative to the first zipper puller 12 due to the engagement of the first limiting groove 1241 and the second limiting groove 2241.

With reference to FIGS. 2 and 3, in the present invention, the positioning protrusion 1242 is formed on and protrudes from the first engaging portion 124 at the first limiting groove 1241 of the first engaging portion 124, and the positioning groove 2242 is formed on the second limiting groove 2241 of the second engaging portion 224. The positioning protrusion 1242 engages with the positioning groove 2242. That is, an outer surface of the positioning protrusion 1242 abuts against an inner surface of the positioning groove 2242 when the first engaging portion 124 of the first zipper puller 12 engages with the second engaging portion 224 of the second zipper puller 22.

With reference to FIGS. 3 to 5, in the present invention, the first zipper puller 12 further has a first protruding section 125, and the second zipper puller 22 further has a second protruding section 225. The first protruding section 125 is located between the first connecting end 121 and the first locking end 122, protrudes toward a direction opposite to the first connecting end 121 and the first locking end 122, or protrudes toward a direction opposite to the luggage A. The second protruding section 225 is located between the second connecting end 221 and the second locking end 222, protrudes toward a direction opposite to the second connecting end 221 and the second locking end 222, or protrudes toward a direction opposite to the luggage A. The first engaging portion 124 is formed on the first protruding section 125, and the second engaging portion 224 is formed on the second protruding section 225.

With reference to FIGS. 1 and 2, the locking assembly 2 is fixed on the luggage A, and the locking assembly 2 locks the first locking ring 123 of the first zipper puller 12 and the second locking ring 223 of the second zipper puller 22. In use, pull both the two zipper pullers 12, 22 individually or pull one single zipper puller 12 or zipper puller 22 to make the corresponding zipper slider 11, 21 slide on a zipper chain until one of the two zipper sliders 11, 21 meets the other one at a position adjacent to the locking assembly 2. Then make the first engaging portion 124 of the first zipper puller 12 engage with the second engaging portion 224 of the second zipper puller 22, such that the second zipper puller 22 intersects the first zipper puller 12 without a gap. Therefore the first zipper puller 12 and the second zipper puller 22 cannot rotate or move relative to each other. Next, lock the first locking ring 123 and the second locking ring 223 on the locking assembly 2. The first engaging portion 124 and the second engaging portion 224 cannot detach from each other unless the locking assembly 2 is unlocked. Thus, a thief is unable to pull the anti-theft zipper 1 down—not even to create a slit. Personal belongings in the luggage A can therefore be well protected. Moreover, since the second zipper puller 22 intersects the first zipper puller 12 before being locked on the locking assembly 2, travelers will not lock only the second zipper puller 22 or the first zipper puller 12 on the locking assembly 2 but forget to lock the other zipper puller.

Moreover, the anti-theft zipper 1 can be applied on the luggage A without the locking assembly 2. The first locking ring 123 and the second locking ring 223 can be locked on a padlock after the first engaging portion 124 of the first zipper puller 12 engages with the second engaging portion 224 of the second zipper puller 22. The thief is still not able to unzip the anti-theft zipper 1.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An anti-theft zipper comprising:

a first zipper slider;

a first zipper puller connected to the first zipper slider and having two ends;

a first left side;

a first right side;

a first connecting end disposed at one of the two ends of the first zipper puller and connected to the first zipper slider;

a first locking end disposed at the other one of the two ends of the first zipper puller;

a first locking ring disposed on the first locking end; and a first engaging portion formed on the first zipper puller and located between the first connecting end and the first locking end; the first engaging portion having:

a first limiting groove formed on the first engaging portion and extending from the first left side of the first zipper puller to the first right side of the first zipper puller; the first limiting groove forming:

a first left opening on the first left side of the first zipper puller; and a first right opening on the first right side of the first zipper puller, wherein a width of the first left opening is unequal to a width of the first right opening;

a second zipper slider; and a second zipper puller connected to the second zipper slider and having two ends;

a second connecting end disposed at one of the two ends of the second zipper puller and connected to the second zipper slider;

a second locking end disposed at the other one of the two ends of the second zipper puller;

a second locking ring disposed on the second locking end; and a second engaging portion formed on the second zipper puller and located between the second connecting end and the second locking end; wherein the second engaging portion is configured to be clamped in the first limiting groove such that the first engaging portion engages with the second engaging portion, which prevents the first zipper puller and the second zipper puller from rotating and moving relative to each other.

2. The anti-theft zipper as claimed in claim 1, wherein the first engaging portion has a positioning protrusion protruding from the first limiting groove; and the second engaging portion has a positioning groove, and the positioning protrusion engages with the positioning groove; wherein the second zipper puller intersects the first zipper puller.

3. The anti-theft zipper as claimed in claim 1, wherein the first zipper puller has a first protruding section located between the first connecting end and the first locking end, and protruding toward a direction opposite to the first connecting end and the first locking end;

the first engaging portion is formed on the first protruding section;

the second zipper puller has a second protruding section located between the second connecting end and the second locking end, and protruding toward a direction opposite to the second connecting end and the second locking end; and the second engaging portion is formed on the second protruding section; wherein the second zipper puller intersects the first zipper puller.

4. An anti-theft zipper comprising:

a first zipper slider;

a first zipper puller connected to the first zipper slider and having two ends;

a first connecting end disposed at one of the two ends of the first zipper puller and connected to the first zipper slider;

a first locking end disposed at the other one of the two ends of the first zipper puller;

a first locking ring disposed on the first locking end; and a first engaging portion formed on the first zipper puller and located between the first connecting end and the first locking end;

a second zipper slider; and a second zipper puller connected to the second zipper slider and having two ends;

a left side; and a right side; and a second connecting end disposed at one of the two ends of the second zipper puller and connected to the second zipper slider;

a second locking end disposed at the other one of the two ends of the second zipper puller;

a second locking ring disposed on the second locking end; and a second engaging portion formed on the second zipper puller and located between the second connecting end and the second locking end; the second engaging portion having:

a limiting groove formed on the second engaging portion and extending from the left side of the second zipper puller to the right side of the second zipper puller; the limiting groove forming:

a left opening on the left side of the second zipper puller; and a right opening on the right side of the second zipper puller, wherein a width of the left opening is unequal to a width of the right opening; and wherein the first engaging portion is configured to be clamped in the limiting groove such that the first engaging portion engages with the second engaging portion, which prevents the first zipper puller and the second zipper puller from rotating and moving relative to each other.

5. The anti-theft zipper as claimed in claim 4, wherein the first engaging portion has a positioning protrusion; and the second engaging portion has a positioning groove formed on the second limiting groove, and the positioning protrusion engages with the positioning groove; wherein the second zipper puller intersects the first zipper puller.

6. The anti-theft zipper as claimed in claim 4, wherein the first zipper puller has a first protruding section located between the first connecting end and the first locking end, and protruding toward a direction opposite to the first connecting end and the first locking end;

the first engaging portion is formed on the first protruding section;

the second zipper puller has a second protruding section located between the second connecting end and the second locking end, and protruding toward a direction opposite to the second connecting end and the second locking end; and the second engaging portion is formed on the second protruding section; wherein the second zipper puller intersects the first zipper puller.

7. A luggage lock fixed on luggage, the luggage lock comprising:

an anti-theft zipper mounted on the luggage and having a first zipper slider;

a first zipper puller connected to the first zipper slider and having two ends;

a first left side;

a first right side;

a first connecting end disposed at one of the two ends of the first zipper puller and connected to the first zipper slider;

a first locking end disposed at the other one of the two ends of the first zipper puller;

a first locking ring disposed on the first locking end; and a first engaging portion formed on the first zipper puller and located between the first connecting end and the first locking end; the first engaging portion having:

a first limiting groove formed on the first engaging portion and extending from the first left side of the first zipper puller to the first right side of the first zipper puller; the first limiting groove forming:

a first left opening on the first left side of the first zipper puller; and a first right opening on the first right side of the first zipper puller, wherein a width of the first left opening is unequal to a width of the first right opening;

a second zipper slider; and a second zipper puller connected to the second zipper slider and having two ends;

a second connecting end disposed at one of the two ends of the second zipper puller and connected to the second zipper slider;

a second locking end disposed at the other one of the two ends of the second zipper puller;

a second locking ring disposed on the second locking end; and a second engaging portion formed on the second zipper puller and located between the second connecting end and the second locking end; wherein the second engaging portion is configured to be clamped in the first limiting groove such that the first engaging portion engages with the second engaging portion, which prevents the first zipper puller and the second zipper puller from rotating and moving relative to each other.

8. The luggage lock as claimed in claim 7, wherein the second zipper puller has a second left side; and a second right side; and the second engaging portion has a second limiting groove formed on the second engaging portion and extending from the second left side of the second zipper puller to the second right side of the second zipper puller; and the first zipper puller is clamped in the second limiting groove.

9. The luggage lock as claimed in claim 8, wherein the second limiting groove forms a second left opening on the second left side of the second zipper puller and forms a second right opening on the second right side of the second zipper puller, wherein a width of the second left opening is unequal to a width of the second right opening.

10. The luggage lock as claimed in claim 7, wherein the first engaging portion has a positioning protrusion protruding from the first limiting groove; and the second engaging portion has a positioning groove, and the positioning protrusion engages with the positioning groove.

* * * * *